US009677712B2

(12) United States Patent
Evans et al.

(10) Patent No.: US 9,677,712 B2
(45) Date of Patent: Jun. 13, 2017

(54) COMPRESSED NATURAL GAS FUELING STATION

(71) Applicant: Ferus Natural Gas Fuels Inc., Calgary, OT (CA)

(72) Inventors: Paul D. Evans, Calgary (CA); Mark Epp, Langley (CA); Sean Marte, Langley (CA); Jan Kroman, Calgary (CA); Michael L. Farrar, Calgary (CA)

(73) Assignee: Ferus Natural Gas Fuels Inc., Calgary (CA)

( * ) Notice: Subject to any disclaimer, the term of this patent is extended or adjusted under 35 U.S.C. 154(b) by 298 days.

(21) Appl. No.: 13/834,095

(22) Filed: Mar. 15, 2013

(65) Prior Publication Data

US 2013/0312870 A1 Nov. 28, 2013

Related U.S. Application Data

(60) Provisional application No. 61/651,970, filed on May 25, 2012.

(51) Int. Cl.
*F17C 5/06* (2006.01)
*E04H 1/12* (2006.01)

(52) U.S. Cl.
CPC ..... *F17C 5/06* (2013.01); *E04H 1/1233* (2013.01)

(58) Field of Classification Search
CPC ..... F17C 5/06; B60S 5/02
USPC ..... 137/356, 363; 52/73–78, 169.6; 220/567.1
See application file for complete search history.

(56) References Cited

U.S. PATENT DOCUMENTS

| | | | | |
|---|---|---|---|---|
| 3,352,116 A | | 11/1967 | Waterman | |
| D302,820 S | * | 8/1989 | Bass | D15/9.2 |
| D309,883 S | | 8/1990 | Barnett | |
| 5,030,033 A | * | 7/1991 | Heintzelman et al. | 405/129.57 |
| 5,037,239 A | * | 8/1991 | Olsen | B09B 1/00 405/129.5 |
| 5,207,530 A | * | 5/1993 | Brooks et al. | 405/55 |
| 5,390,713 A | * | 2/1995 | Fiech | 141/98 |
| 5,503,014 A | | 4/1996 | Griffith | |
| 5,505,232 A | * | 4/1996 | Barclay | 141/11 |

(Continued)

OTHER PUBLICATIONS

"Safe—Gas Designed for You," Internet Source, URL: http://www.safe-ita.com/english/applications_cng_other_types.html, accessed May 23, 2014.

(Continued)

*Primary Examiner* — Kevin Murphy
*Assistant Examiner* — Nicole Wentlandt
(74) *Attorney, Agent, or Firm* — Sheppard, Mullin, Richter & Hampton LLP

(57) ABSTRACT

A compressed natural gas (CNG) fueling station module is provided. The module includes a vault for below grade installation, the vault comprising a compressor for compressing natural gas, a storage tank for holding compressed natural gas, a dispenser for dispensing compressed natural gas, each of the compressor, the storage tank and the dispenser in fluid communication with each other. Secured to the vault is a canopy for above grade orientation, the canopy comprising a CNG fuel nozzle in fluid communication with the dispenser and an interface for allowance purchase of the CNG.

9 Claims, 11 Drawing Sheets

(56) References Cited

U.S. PATENT DOCUMENTS

| | | | | |
|---|---|---|---|---|
| 5,586,586 | A * | 12/1996 | Fiech | B60S 5/02 137/234.6 |
| 5,638,904 | A | 6/1997 | Misselbrook et al. | |
| 5,954,085 | A * | 9/1999 | Moore et al. | 137/234.6 |
| 6,340,269 | B1 * | 1/2002 | Stanton et al. | 405/53 |
| 6,637,976 | B2 * | 10/2003 | Stanton | 405/53 |
| 6,732,769 | B2 * | 5/2004 | Del Campo | 141/97 |
| 6,810,924 | B2 * | 11/2004 | White | 141/82 |
| 6,899,146 | B2 * | 5/2005 | Bingham et al. | 141/11 |
| 2006/0162811 | A1 * | 7/2006 | Roach | 141/325 |

OTHER PUBLICATIONS

CNG in a Box System, Internet Source, URL: http://www.ge-energy.com/content/multimedia/__files/downloads/GE_CNG__Brochure-120512-2-Web-Pages.pdf, accessed May 23, 2014.

* cited by examiner

COMPRESSED NATURAL GAS FUELING STATION

PRIORITY CLAIM

This application claims the benefit of and incorporates by reference U.S. Provisional Application No. 61/651,970, filed on May 25, 2012 and entitled "Compressed Natural Gas Fueling Station."

FIELD OF THE INVENTION

The present invention relates to a fueling station and more specifically to a fueling station for compressing, storing and delivering compressed natural gas (CNG) to vehicles.

BACKGROUND

As the use of CNG as a transportation fuel for vehicles including off-road machinery becomes more popular, CNG fueling stations are becoming more necessary.

Generally, CNG fueling stations comprise a number of mechanical and electrical components situated above ground for dispensing CNG transportation fuel. A conventional station requires a large surface area, or footprint, due to safety offsets between hazardous and non-hazardous areas surrounding the equipment. The footprint required to accommodate the fueling station requires an abundance of real estate and results in an unsightly fueling station. In an urban setting, such a fueling station can be costly as the real estate is expensive or possibly even implausible if there simply is not enough space to accommodate a traditional setup. In addition, expansion of the station in the event of increased volume is extremely difficult as more space is required for the compressors and storage tanks for the CNG.

An effort has been made to move some of the equipment, such as the compressors and storage tanks, into poured in place basements below ground. This reduces some of the unsightly equipment above ground but requires a significant investment as a significant excavation of the site is required to build and pour in place the basements below the ground. The addition of further basements in the event that increased demand is observed also requires a significant investment as does removal of the basements in the event that the station is closed or removal is required. In addition, due to the layout of the basements which include hallways and access doors from the hallways, the footprint of these poured in place basements still requires a significant amount of real estate although reduced as compared to above ground equivalent stations.

A need therefore exists for a CNG fueling station that allows for packaging that reduces the footprint of the fueling station, without sacrificing safety.

SUMMARY OF THE INVENTION

A CNG fueling station module is provided that includes an above grade canopy for sheltering a user and for providing an interface for the user and a below grade vault that houses the components necessary to take natural gas input, for example, from a pipeline, and compress, store and dispense it in a form suitable for use as a CNG fuel. The canopy may be incorporated directly into the vault making the entire module a single modular fueling station. The vault may itself be prefabricated off-site with, optionally, all of the necessary CNG components pre-installed before installation of the vault on-site below grade. In addition, an air vent may be integrated in the canopy in fluid communication with the vault for venting air from the vault out through the canopy to cool the vault and increase safety. In one embodiment, the canopy and the vault are oriented to one another to minimize the footprint of the fueling station module so that the least amount of real estate is required to provide a usable CNG fueling station. The roof of the vault may be mounted at grade so that vehicles may park directly on top of the vault and under the canopy when fueling so that the user is sheltered by the canopy while fueling and while minimizing the footprint of the fueling station module.

In one embodiment, the present invention provides for a CNG fueling station module comprising:

- a vault for below grade installation, the vault comprising a compressor for compressing natural gas, a storage tank for holding compressed natural gas, a dispenser for dispensing compressed natural gas, each of the compressor, the storage tank and the dispenser in fluid communication with each other;
- a canopy secured to the vault for above grade orientation, the canopy comprising a CNG fuel nozzle in fluid communication with the dispenser and an interface for allowing purchase of the CNG.

In a further embodiment of the fueling station module to that outlined above, the canopy further comprises a ventilation duct in fluid communication with the interior of the vault for exhausting air from the interior of the vault through the canopy to the ambient environment.

In a further embodiment of the fueling station module to that outlined above, the canopy and the vault are integrated together and the vault acts as a counterweight to the canopy.

In a further embodiment of the fueling station module to that outlined above, the canopy is oriented so that it extends over the vault to minimize the footprint of the module.

In a further embodiment of the fueling station module to that outlined above, the vault is prefabricated off-site for on-site installation.

In a further embodiment of the fueling station module to that outlined above, the vault and the canopy are prefabricated off-site for on-site installation.

In a further embodiment of the fueling station module to that outlined above, a roof of the vault is positioned at grade so that a vehicle to be fueled may be positioned on top of the vault.

In a further embodiment of the fueling station module to that outlined above, the roof of the vault is positioned at grade and the canopy is oriented at least substantially away from the roof of the vault.

In another embodiment, the present invention provides for a modular CNG vault for below grade installation at a CNG fueling station, the vault comprising:

- a compressor for compressing natural gas, a storage tank for holding compressed natural gas, a dispenser for dispensing compressed natural gas to a nozzle, each of the compressor, the storage tank and the dispenser in fluid communication with each other.

DETAILED DESCRIPTION

One example of a CNG fueling station module is shown in FIGS. 1, 2 and 3A-3C at 10. The module 10 includes an above grade portion for both providing shelter for a user from the elements as well as an interface for access to a fuel nozzle, payment, fuel selection, etc. The above grade portion comprises a canopy 14 that is anchored to the below grade portion which will be referred to as a vault 12. The vault 12 houses the necessary components to take natural gas input into the vault from, for example a pipeline, and store, compress and dispense CNG suitable for use as a fuel to a fuel nozzle in the canopy 14 for delivering the CNG to a vehicle positioned substantially above the vault 12. The vault 12 may be located so that a roof 18 of the vault 12 is substantially level with grade and does not create a barrier to traffic flow but rather supports a vehicle parked on top of the vault 12 for fueling. The canopy 14 and the vault 12 may be oriented to minimize the footprint of the fueling module and a vehicle may be parked substantially on top of the vault 12 and below the canopy 14 so that the canopy 14 provides shelter and optionally lighting to the user.

By packaging the components to compress, store and dispense the CNG inside the vault 12 and placing the vault 12 below grade in a position and orientation below the canopy 14 the footprint required to provide a CNG fueling station is reduced as compared to above grade CNG fueling stations where the compressors and storage tanks are above ground and also as compared to those fueling stations which include below grade compressor rooms and storage rooms. In addition, by moving the mechanical and electrical components such as the compressors below grade, the noise generated by the compressors is greatly reduced at ground level. Further, security against unauthorized access is greatly increased.

The vault 12 can be similar in footprint to a large vehicle meaning that the fueling station module 10 may be positioned in an urban area without the need for a large amount of costly real estate. In addition, as the above ground portion comprises mostly of the canopy 14, unsightly compressors and storage tanks are no longer an issue as they are below grade and out of sight.

Figure 1:
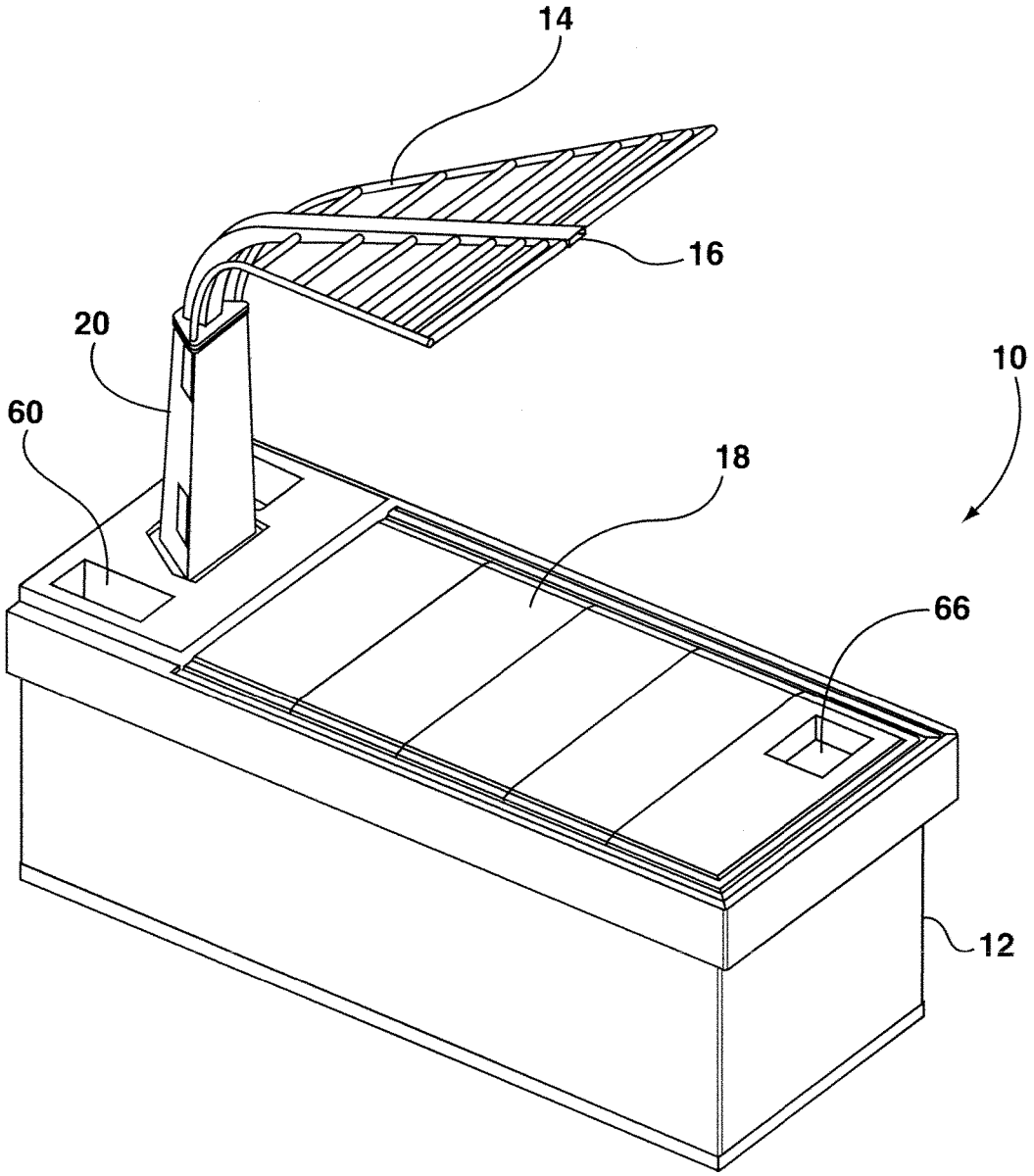
FIG. 1 is a schematic illustrative of one embodiment of a CNG fueling station comprising both a subterranean vault for positioning at or below grade and a canopy for positioning above grade.
Figure 2:
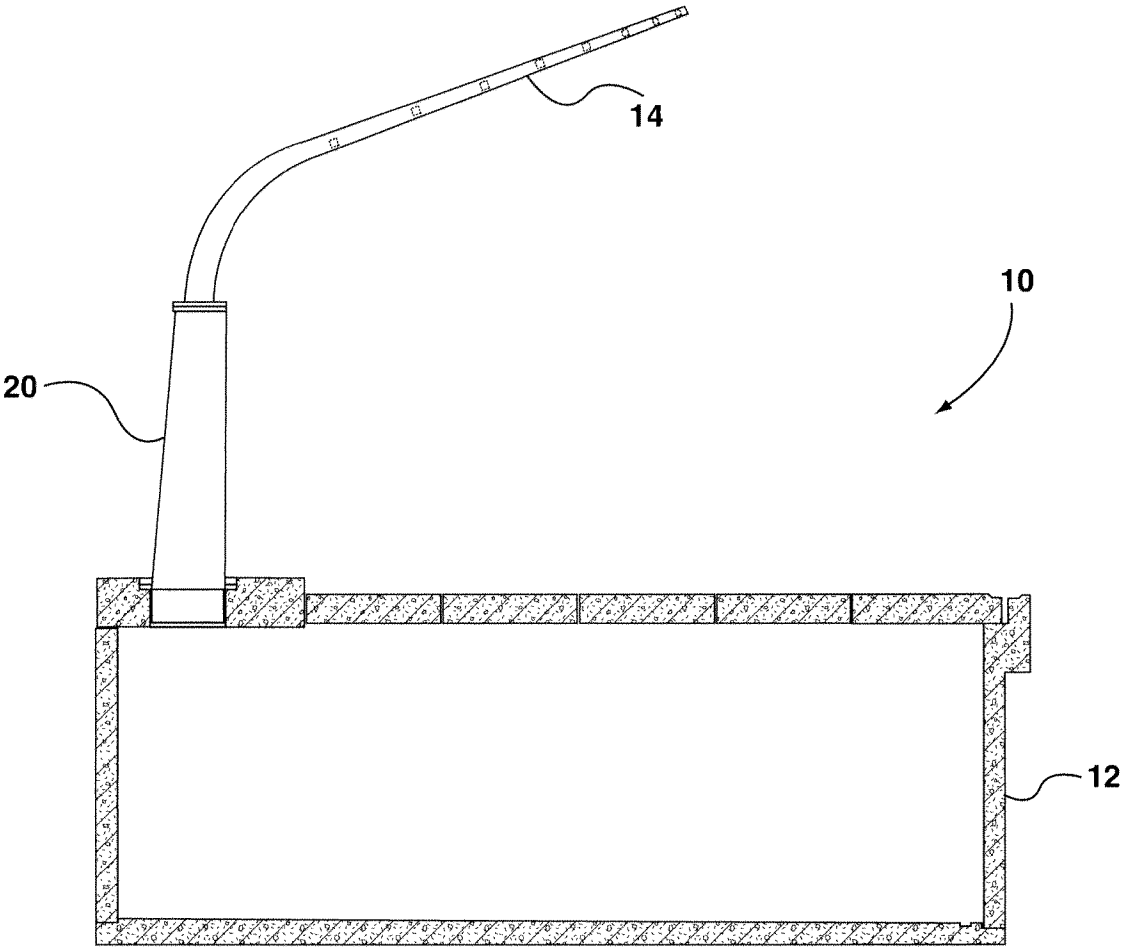
FIG. 2 is a schematic side view illustrative of the CNG fueling station of FIG. 1.

The canopy 14 extends upwards from the vault 12 and arches over the intended user. In FIG. 1, the exterior shell of the canopy 14 has been omitted so that the structure including a support tube 16 extending from the top of the vault 12 for providing a structural support for the arched canopy is visible. A vertical or substantially upright portion 20 allows for an interface between the user and the module 10. It will be appreciated that any substructure or frame for the canopy may be used to provide sufficient strength and support to the canopy 14 that allows for the canopy to safely arch over a user.

Figure 3B:
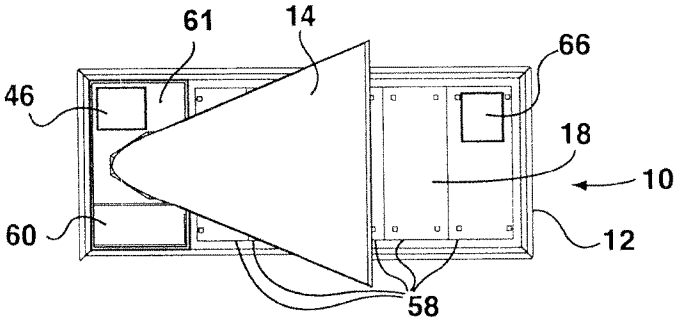
FIGS. 3A-3C are schematic views illustrative of one embodiment of a CNG fueling station comprising both a vault for positioning at or below grade and a canopy for positioning above grade.
Figure 3C:
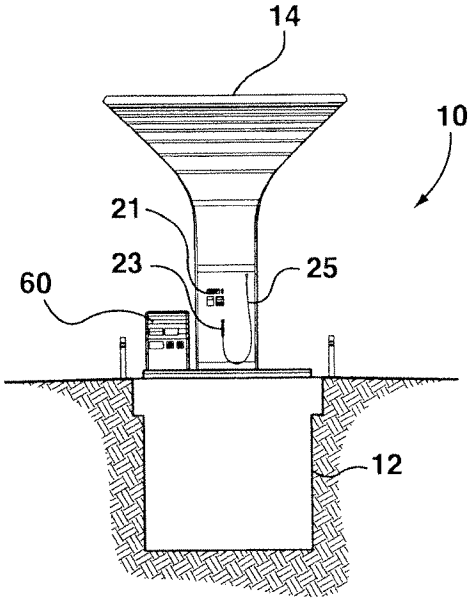
Figure 3A:
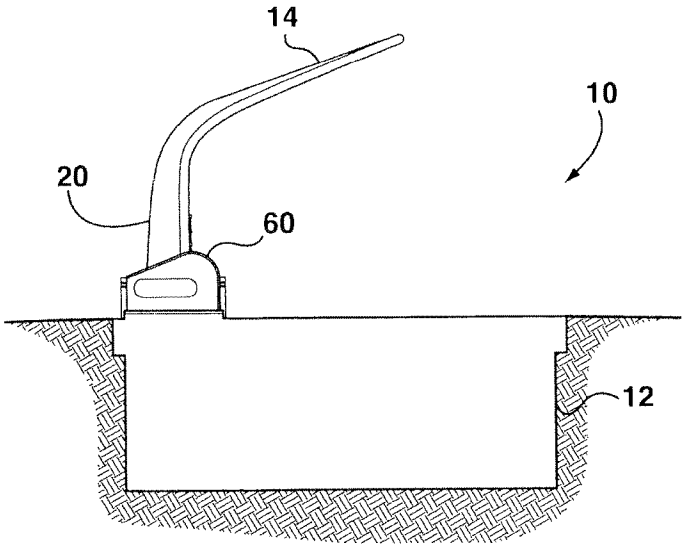
Figure 4A:
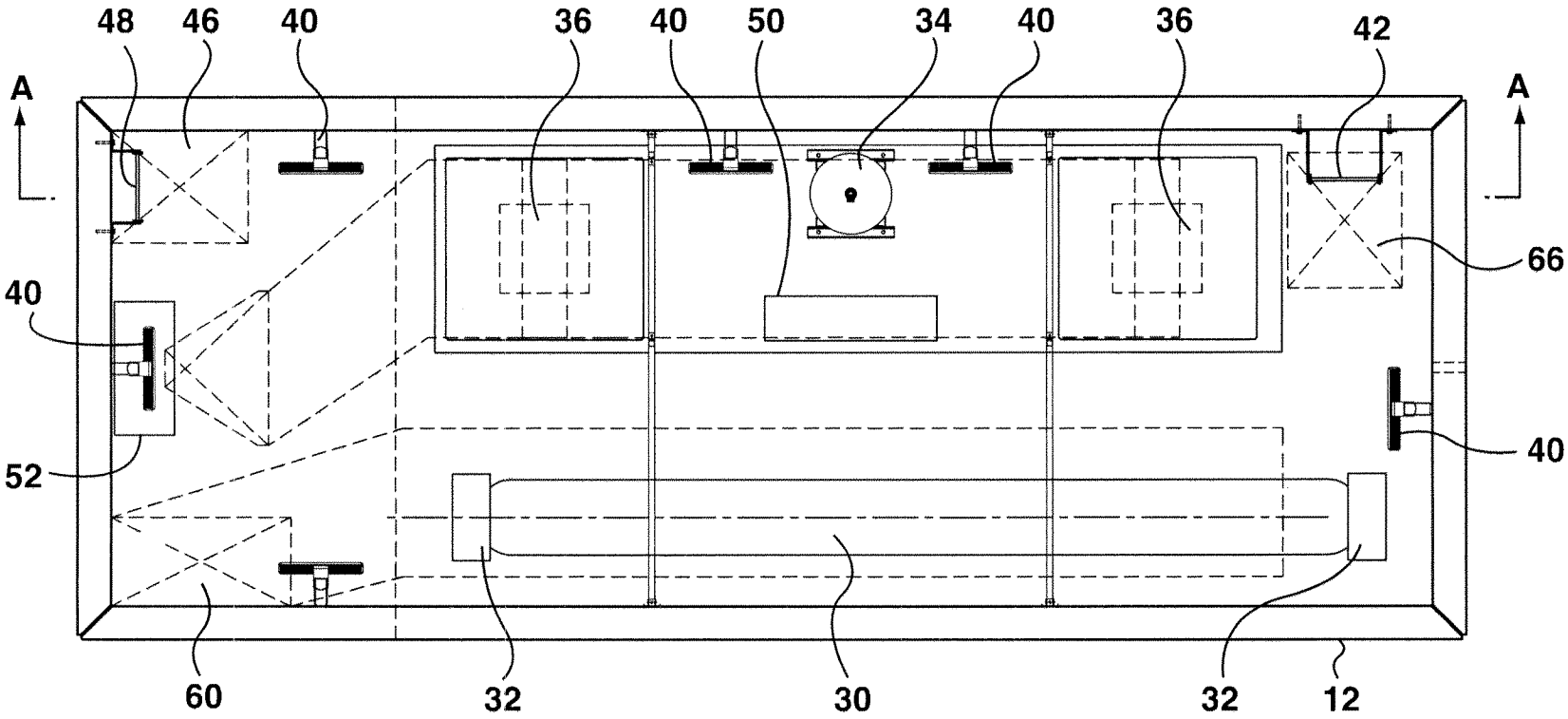
FIG. 4A is a plan view illustrative of one embodiment of a subterranean vault for positioning at or below grade.
Figure 4B:
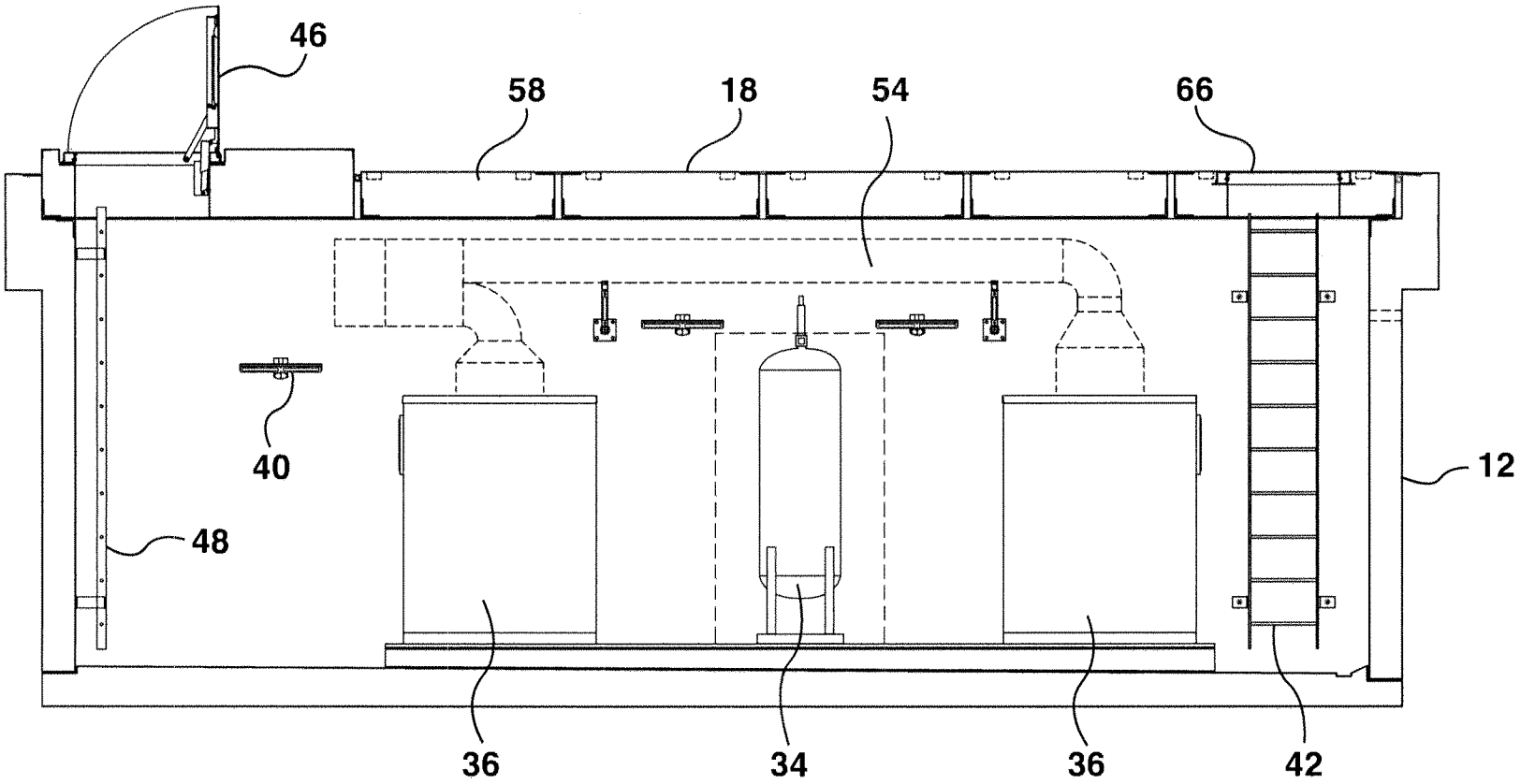
FIG. 4B is a cross-sectional view of the vault of FIG. 4A taken along line A-A.
Figure 5A:
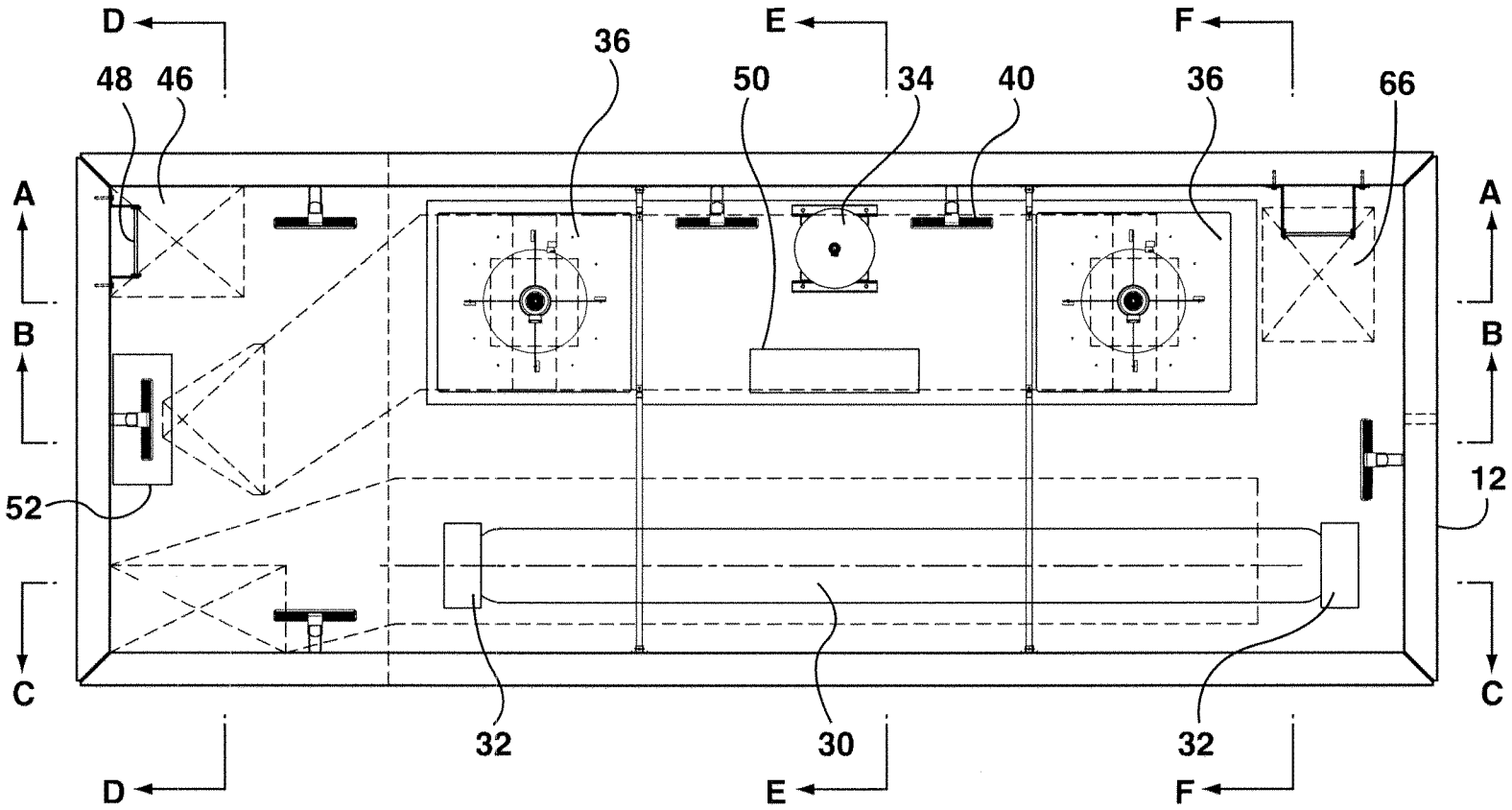
FIG. 5A is a plan view illustrative of one embodiment of a subterranean vault for positioning at or below grade.
Figure 5B:
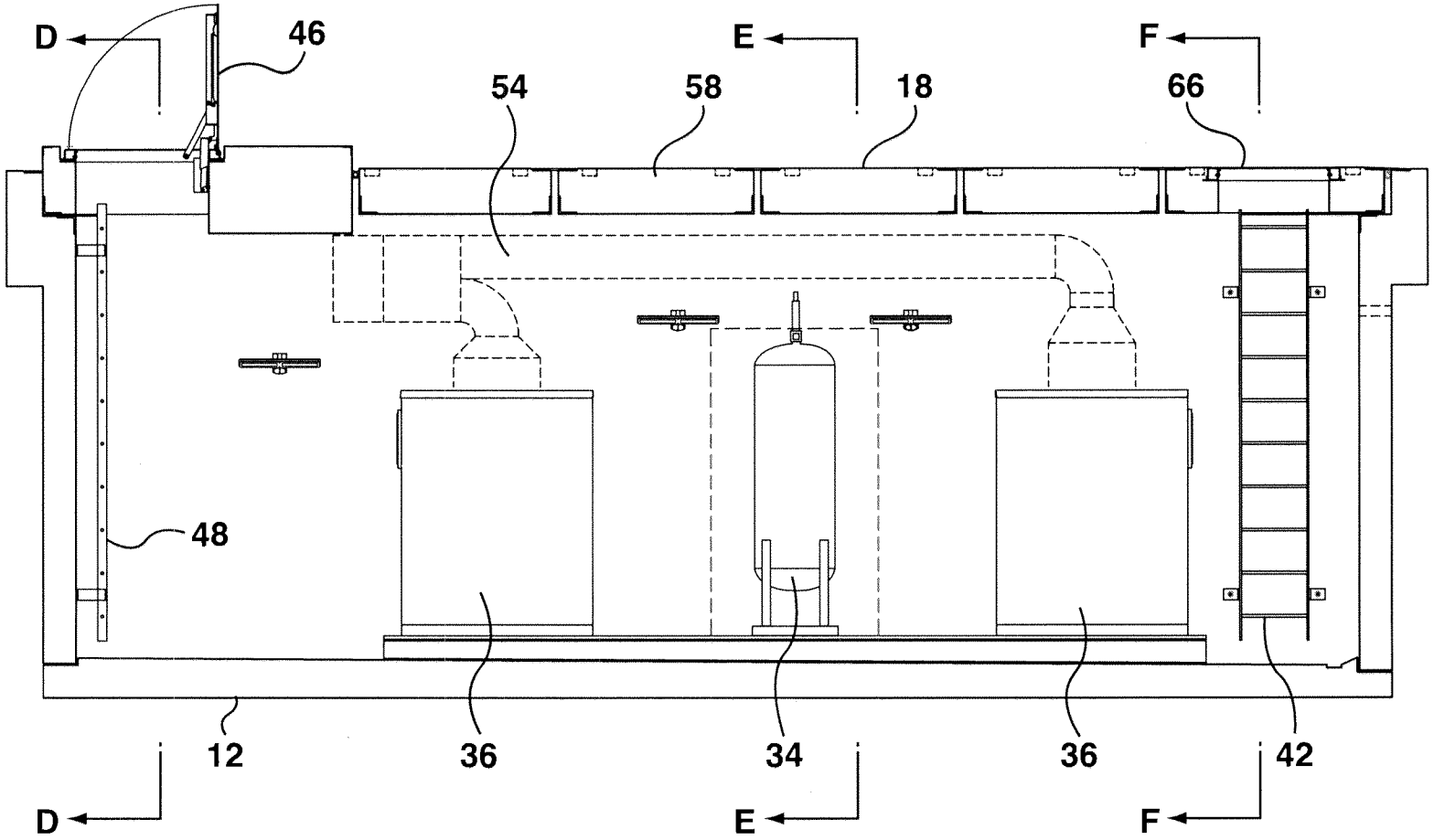
FIG. 5B is a cross-sectional view of the vault of FIG. 5A taken along line A-A.
Figure 5C:
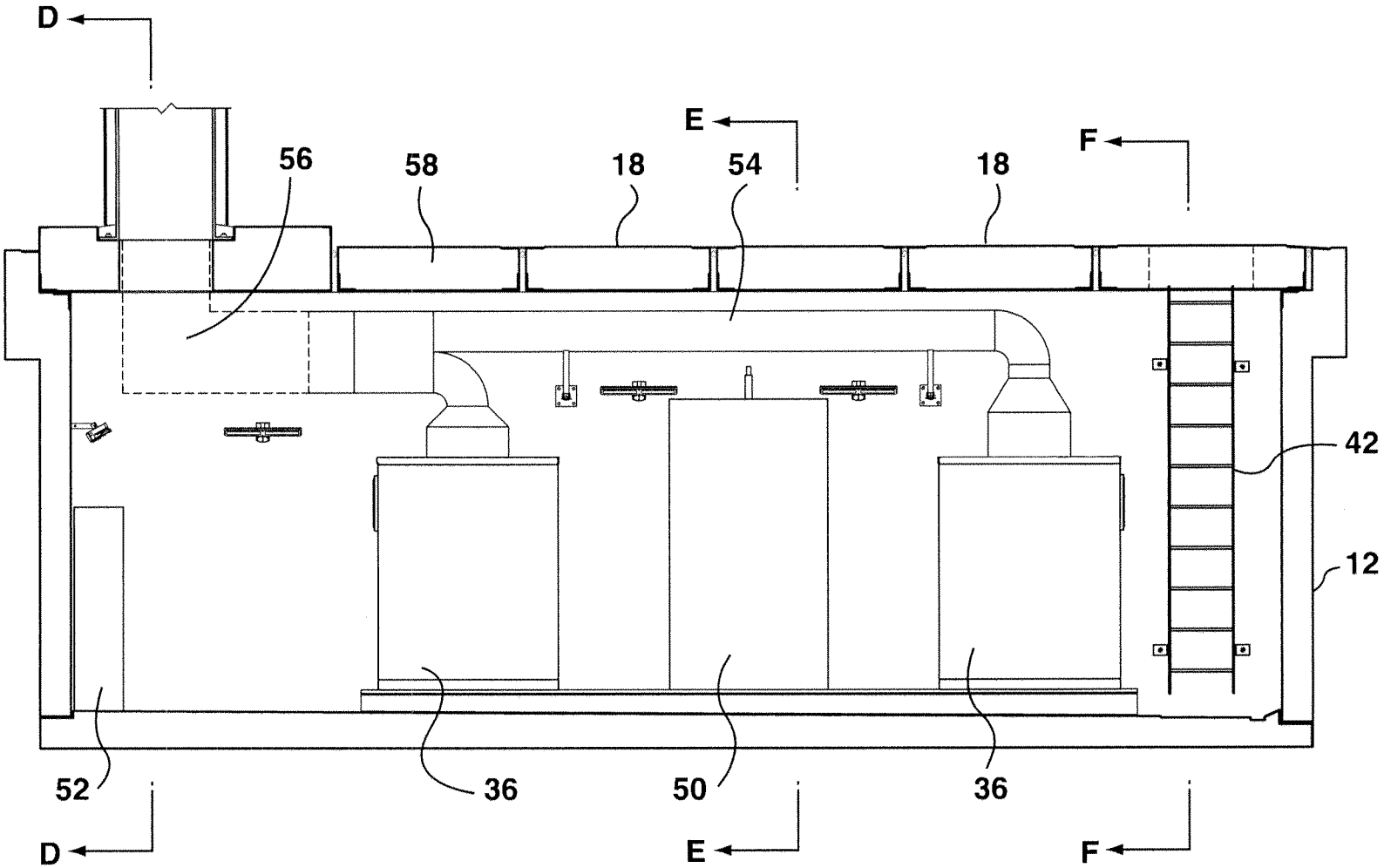
FIG. 5C is a cross-sectional view of the vault of FIG. 5A taken along line B-B.
Figure 5D:
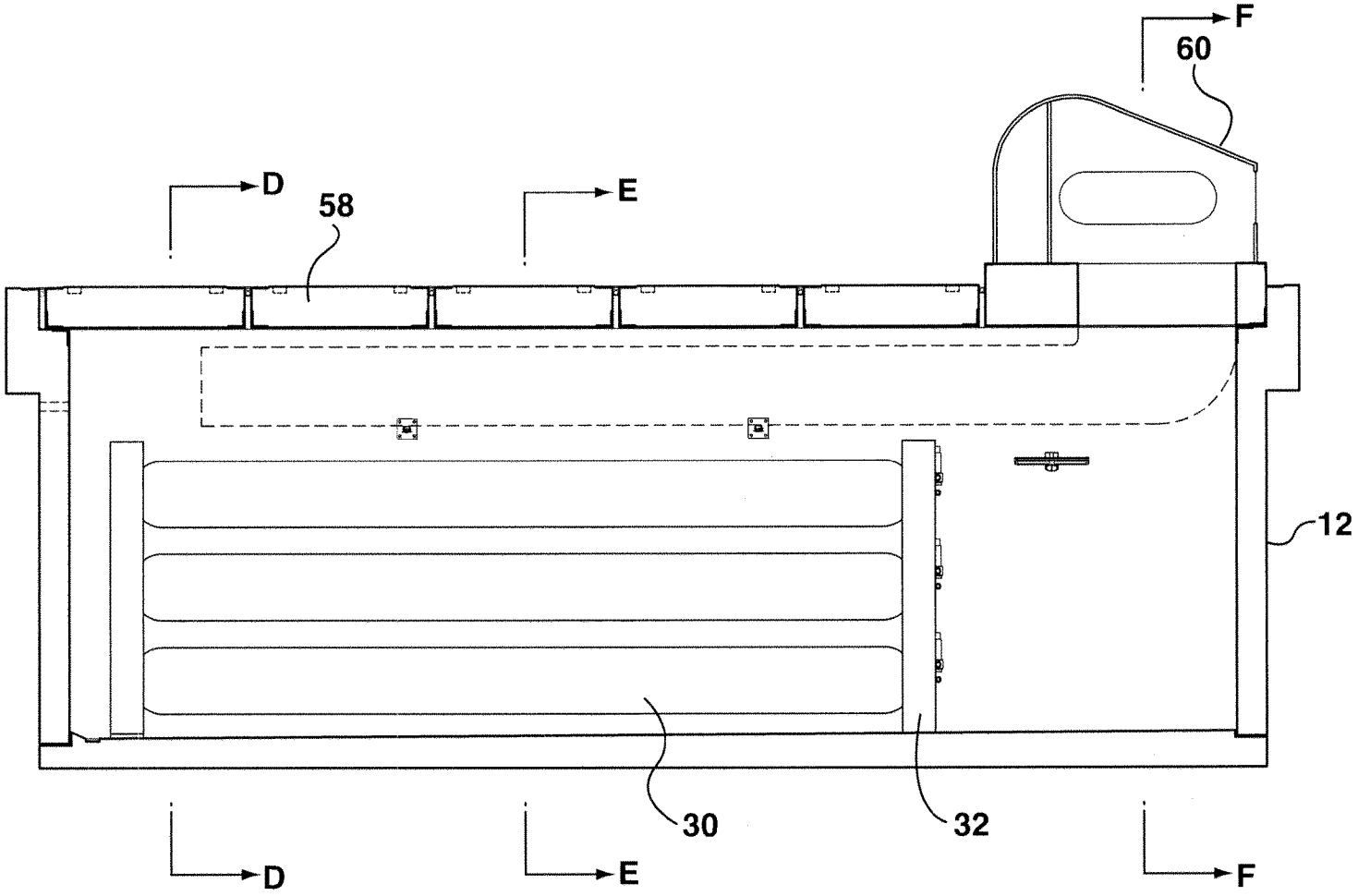
FIG. 5D is a cross-sectional view of the vault of FIG. 5A taken along line C-C.
Figure 5F:
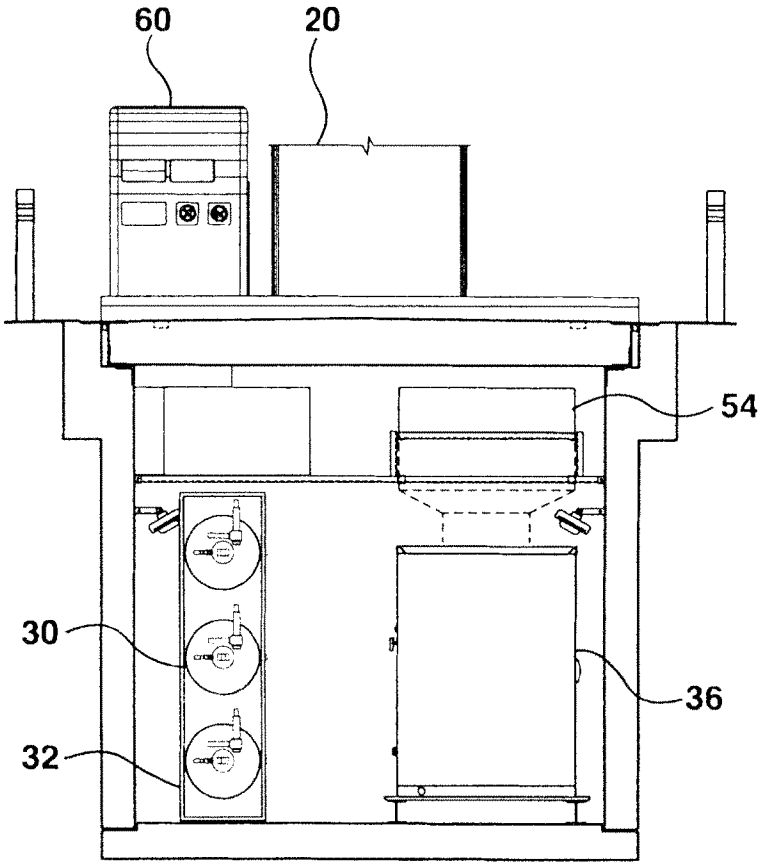
FIG. 5F is a cross-sectional view of the vault of FIG. 5A taken along line E-E.
Figure 5E:
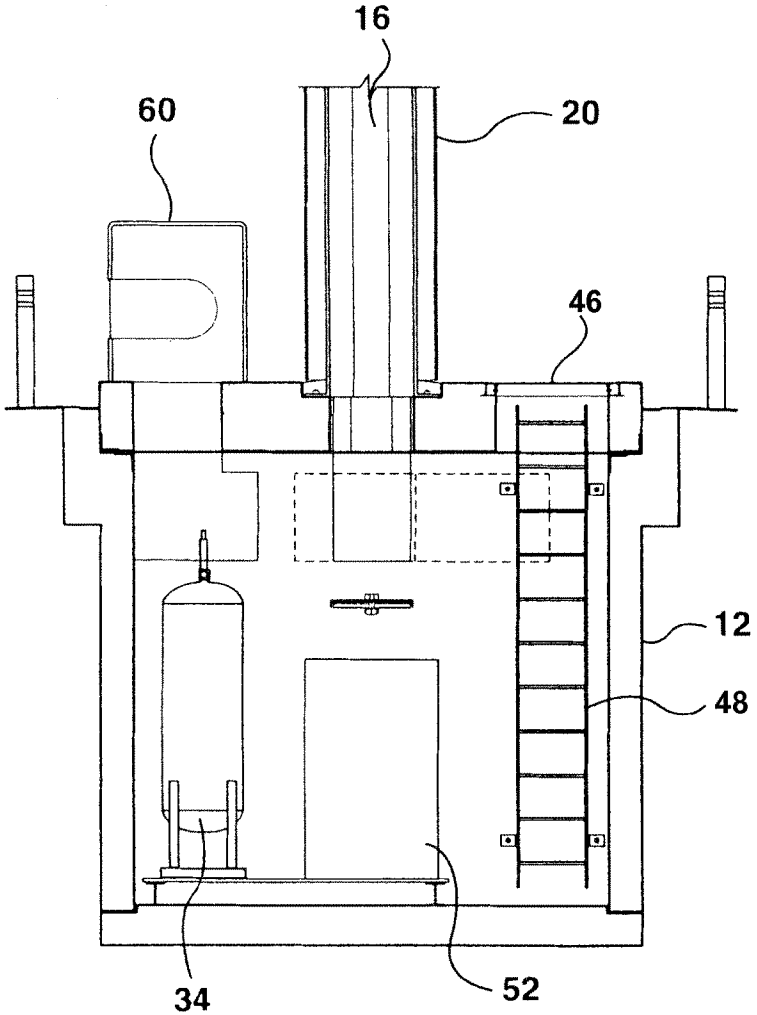
FIG. 5E is a cross-sectional view of the vault of FIG. 5A taken along line D-D.
Figure 5G:
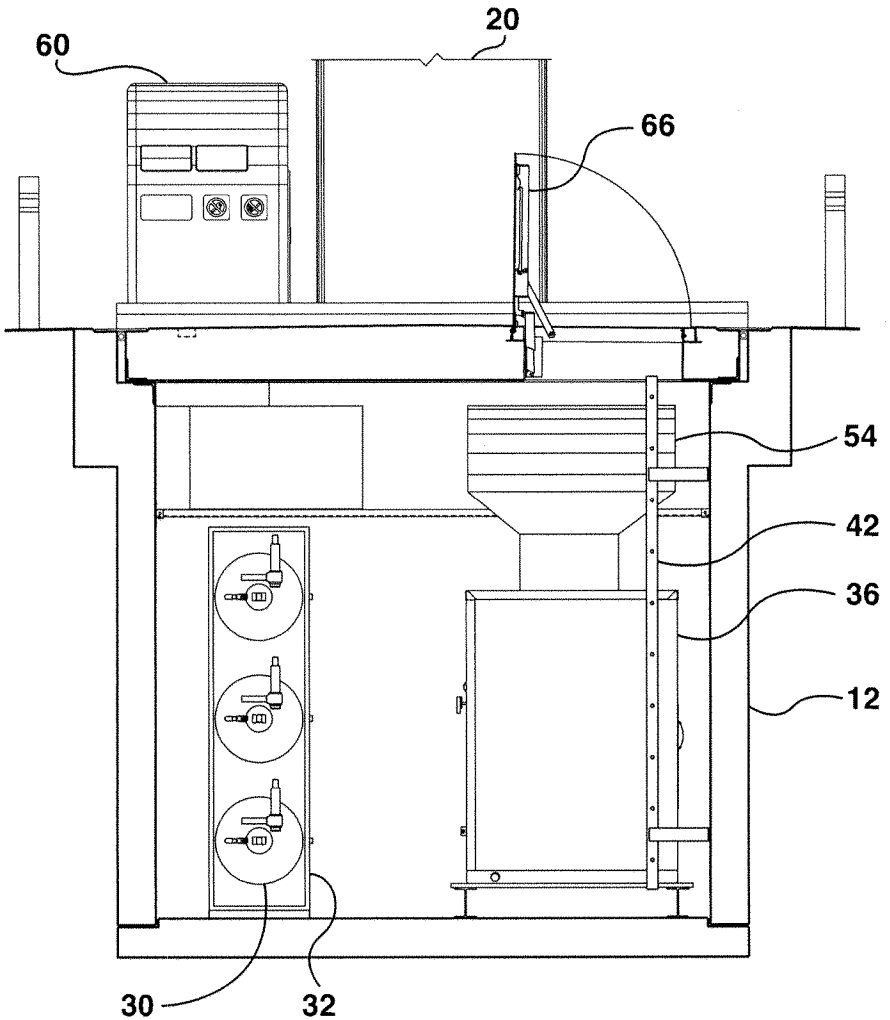
FIG. 5G is a cross-sectional view of the vault of FIG. 5A taken along line F-F.

With reference to FIGS. 3A-3C, the vault 12 and canopy 14 are shown in side, top and front schematic views, respectively. The vault 12 is shown including a maintenance access hatch 46 and emergency access hatch 66 that allow access to the vault 12 from the surface. An intake air duct is also shown at 60 that provides for air intake into the vault 12 as needed. The canopy 14 includes a fueling nozzle 23 for interface with a vehicle to be fueled. The fueling nozzle 23 is in fluid communication with a dispenser in the vault and may at least be partially connected to the dispenser with a flexible CNG fueling hose 25.

With reference to FIGS. 4A-5G, the vault 12 and canopy 14 contain CNG equipment required to take natural gas supplied to the vault from, for example, a pipeline, and compress, store and dispense suitable CNG for fueling of a vehicle such as a compressor 36, a storage tank 30, a dispenser 52, access ladders 42 and 48, lighting 40, access hatches 46 and 66, ducting 54 and 56, a gas dryer 34, a storage rack 32, electrical cabinet 50, and other equipment needed for monitoring, flow control and ventilation to ensure the safe operation of the fueling station module 10. The vault 12 also acts to protect the equipment contained within from the environment and provides noise attenuation as outlined above. In addition the vault 12 may also be used as a foundation for attachment and support of the canopy 14 thereby integrating the canopy with the vault 12 and forming a single module. The vault 12 may also act as a counterweight for the canopy 14. In a further embodiment, the roof 18 of the vault 12 is separated into several sections. One section includes an integral fuel island 61 nominally above grade that also provides the connection for the canopy. The other sections 58 of the roof 18 may be individually removable to provide full access to the vault 12 for installing or removing the large pieces of equipment. A maintenance access hatch 46 may be provided in the fuel island 61 for regular maintenance. A second emergency access hatch 66 may be built into one of the removable roof sections 58. The packaging of the equipment inside the vault 12 provides the necessary space for egress and equipment access in a minimum or reduced amount of space.

Inside the vault 12 a natural gas compressor 36 is connected to a gas source, typically a low pressure gas supply line (not shown) which enters through the wall of the vault 12. The natural gas is typically supplied by a gas distribution pipeline. The natural gas compressor 36 increases the pressure of the gas so that it is suitable for on-board storage in automotive vehicles. At least one tank 30 suitable for storage of high pressure natural gas is used to store and supply high pressure natural gas at a rate that is higher than the compressor capacity when needed. A dispenser 52 is used to control and meter the flow of gas to the automotive vehicle. In one embodiment the sizing and packaging of the equipment allows for a second natural gas compressor 36 to be added with a minimum of additional labour and material.

As outlined above, one of the canopy's functions is to provide the customers of the fueling station with shelter from the elements such as rain, snow, etc. and optionally lighting. The canopy 14 comprises of a mostly vertical section 20 extending from the top of the vault 12 which provides structural support for a more horizontal overhead cover. Contained within the canopy mostly vertical section 20 are air ducts in fluid communication with the interior of the vault 12 and the exterior ambient environment. These air ducts are sized to meet the necessary air flow requirements to dissipate the heat of compression created by the natural gas compressor 36 located inside the vault 12. Also contained within the mostly vertical section 20 are one or more relief lines in fluid communication with the various relief valves located on the equipment inside the vault 12. The relief valves protect the equipment from over pressure by venting gas during abnormal conditions, such as a fire. The relief lines are also in fluid communication with the exterior ambient environment and these lines direct the relieved gas from the relief valves to a location above the canopy. As hot air and natural gas are both lighter than ambient air, release of these gases through a top side of the canopy is possible as the gases will dissipate away from a user.

The canopy 14 contains an external attachment for one end of a flexible CNG fueling hose 25. The other end of the flexible CNG fueling hose 25 is in fluid communication with a fueling nozzle 23 for allowing a user to fill their vehicle with CNG. The canopy 14 is equipped with a receiver designed to hold the fueling nozzle 23 when not in use. A rigid line located inside the canopy 14 passes through the integral fuel island 61 and provides fluid communication between the dispenser 52 and the flexible fueling hose 25. An automated electronic customer interface 21 may be located in the substantially upright portion 20 of the canopy for processing payment for the CNG.

The vault 12 may further include provisions for gas leak detection within the vault 12. Further, sensors for detecting an increase in temperature may be provided within the vault 12. Active ventilation of the vault 12, optionally through the canopy 14, may be carried out in the event that a gas leak and/or increased temperature is detected.

The module 10 may be installed at the fueling site and in the event of increased volume the fueling modules are scalable and further modules may simply be added to the site thereby increasing the volume of potential CNG fueling. In addition, the module 10 may be installed at a gasoline fueling site so that a single fueling station can provide both gasoline and CNG.

The vault 12 may be prefabricated off-site using, for example, cast concrete and then transported to the end site and installed. In addition, all or part of the components may be installed in the vault before transport essentially making the vault 12 a modular vault that allows for multiple or further vaults 12 to be installed at the side at or after initial setup of the CNG fueling station. Further modular vaults may simply be added as demand increases. By prefabricating the vaults off-site a cost reduction may be observed.

As the vault 12 and canopy 14 may be fabricated separately, during the development of a CNG fueling station, a plurality of vaults 12 may be installed below grade without the need to attach a canopy 14 to each vault 12. As volume warrants, the equipment and canopy 14 may be added later thereby reduced the time and expense of expansion.

The vault 12 may further include a sump pump (not shown) positioned at the bottom, below the floor or is a lowered section of the vault 12. It will be appreciated that the sump pump should be positioned in an area where fluid is more likely to collect in order to operate effectively.

It will be appreciated that the canopy 14 and the vault 12 may be oriented so that a vehicle can be parked on top of the vault and substantially underneath the canopy to both minimize the footprint of the fueling station module and provide shelter to the user during fueling. However, the canopy may also be oriented in any other direction and does not need to be oriented to be substantially over the vault to minimize the footprint of the fueling station module. In various situations, it may be desirable for the canopy to be oriented away from the vault and such an orientation is possible within the scope of the invention.

An increase in safety is also observed as the compressor 36 and storage tank 30 are positioned below ground thereby reducing the damage caused by vehicle impact into CNG fueling station.

It will be appreciated that further compressors and/or storage tanks may be added to the vault 12 as volume warrants. It will also be appreciated that the setup shown throughout the figures is simply one possible setup and that the orientation and positioning of the equipment in the vault is simply one possible orientation and that other orientations and positions for the equipment may be carried out without departing from the spirit of the invention. In addition, various configurations of the canopy may be implemented without departing from the spirit of the invention and the canopy is not limited to the shape of that shown throughout the figures.

The present invention has been described with regard to a plurality of illustrative embodiments. However, it will be apparent to persons skilled in the art that a number of variations and modifications can be made without departing from the scope of the invention as defined in the claims.

We Claim:

1. A CNG fueling station module comprising:

a vault for below grade installation, the vault comprising a compressor for compressing natural gas, a storage tank for holding compressed natural gas, a dispenser for dispensing compressed natural gas, each of the compressor, the storage tank and the dispenser in fluid communication with each other; and a canopy secured to the vault for above grade orientation, the canopy comprising a CNG fuel nozzle in fluid communication with the dispenser and an interface for allowing purchase of the CNG;

wherein the canopy comprises one or more air ducts in communication with an interior of the vault and the exterior environment, the air ducts providing air flow for dissipating heat outside the vault;

wherein the canopy comprises one or more relief lines in communication with one or more relief valves in connection with one or more of the CNG compressor, storage tank, and dispenser, the one or more relief lines and relief valves providing protection from over pressure by directing gas relieved from the one or more relief valves to a location above the canopy; and wherein a roof of the vault comprises a plurality of adjacent individually removable sections for providing access to the vault.

2. The CNG fueling station module of claim 1, wherein the canopy and the vault are integrated together and the vault acts as a counterweight to the canopy.

3. The CNG fueling station module of claim 1, wherein the canopy is oriented so that it extends over the vault to minimize a footprint of the module.

4. The CNG fueling station module of claim 1, wherein the vault is prefabricated off-site for on-site installation.

5. The CNG fueling station module of claim 1, wherein the vault and the canopy are prefabricated off-site for on-site installation.

6. The CNG fueling station module of claim 1, wherein the roof of the vault is positioned at grade so as to allow a vehicle to be fueled to be positioned on top of the vault.

7. The CNG fueling station module of claim 1, wherein the roof of the vault is positioned at grade and the canopy is oriented away from the roof of the vault.

8. The CNG fueling station module of claim 1, wherein the canopy comprises an upright section extending from a top of the vault and an overhead cover supported by the upright section, and wherein the one or more relief lines and relief valves provide protection from over pressure by directing gas relieved from the one or more relief valves to a location above the overhead cover of the canopy.

9. The CNG fueling station module of claim 8, wherein the overhead cover of the canopy extends over the roof of the vault.

* * * * *